US007357108B2

(12) United States Patent
Gracyalny

(10) Patent No.: US 7,357,108 B2
(45) Date of Patent: Apr. 15, 2008

(54) VALVE-OPERATING MECHANISM

(75) Inventor: Gary Gracyalny, Elm Grove, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 151 days.

(21) Appl. No.: 11/304,044

(22) Filed: Dec. 15, 2005

(65) Prior Publication Data

US 2007/0137597 A1 Jun. 21, 2007

(51) Int. Cl.
*F01L 1/18* (2006.01)

(52) U.S. Cl. ..... 123/90.4; 123/90.27; 123/90.39; 123/90.44; 123/90.6

(58) Field of Classification Search ..... 123/90.4, 123/90.27, 90.39, 90.44, 90.6, 90.24
See application file for complete search history.

(56) References Cited

U.S. PATENT DOCUMENTS

| | | | | |
|---|---|---|---|---|
| 1,997,842 | A | 4/1935 | Waltz | |
| 2,225,102 | A | 12/1940 | Daub | |
| 2,402,972 | A | 7/1946 | Mitchell | |
| 2,732,244 | A | 1/1956 | Gaines | |
| 3,292,604 | A | 12/1966 | Riffe | |
| 3,924,490 | A | 12/1975 | Mills | |
| 4,080,977 | A | 3/1978 | Ogasawara | |
| 4,372,176 | A * | 2/1983 | Terry | 74/409 |
| 4,432,310 | A | 2/1984 | Waller | |
| 4,621,596 | A | 11/1986 | Uchinishi | |
| 4,656,980 | A | 4/1987 | Ohkoshi | |
| 4,706,617 | A | 11/1987 | Asai et al. | |
| 4,714,056 | A | 12/1987 | Tottori et al. | |
| 4,772,186 | A | 9/1988 | Pyles et al. | |
| 4,790,278 | A | 12/1988 | Schlosser et al. | |
| 4,797,074 | A | 1/1989 | Albert | |
| 4,979,406 | A | 12/1990 | Waller | |
| 5,065,720 | A | 11/1991 | Nishiyama et al. | |
| 5,143,033 | A | 9/1992 | Catterson et al. | |
| 5,644,949 | A | 7/1997 | Murakami et al. | |
| 6,253,718 | B1 | 7/2001 | Uchida et al. | |
| 6,276,324 | B1 | 8/2001 | Adams et al. | |
| 6,505,590 | B1 | 1/2003 | Rao et al. | |
| 6,810,849 | B1 | 11/2004 | Hirsch et al. | |

FOREIGN PATENT DOCUMENTS

| | | |
|---|---|---|
| BE | 336684 | 10/1926 |
| DE | 464127 | 8/1928 |
| DE | 1039781 | 9/1958 |
| DE | 1181490 | 11/1964 |

(Continued)

*Primary Examiner*—Zelalem Eshete
(74) *Attorney, Agent, or Firm*—Michael Best & Friedrich, LLP

(57) ABSTRACT

A valve operating system for an engine that includes a piston that reciprocates along a piston axis. The valve operating system includes a valve member that is movable along a valve axis between a first position and a second position and a crankshaft that is rotatable about a crank axis. A cam member includes a substantially non-planar non-cylindrical surface and a cam profile superimposed thereon. A drive linkage interconnects the cam member and the crankshaft such that the cam member rotates in response to rotation of the crankshaft. A rocker arm is engaged with the valve member and the cam profile to move the valve member in response to rotation of the cam member.

36 Claims, 10 Drawing Sheets

FOREIGN PATENT DOCUMENTS

| | | |
|---|---|---|
| DE | 4136505 | 5/1993 |
| EP | 1043481 | 10/2000 |
| GB | 222238 | 10/1924 |
| GB | 229033 | 2/1925 |
| GB | 233032 | 4/1925 |
| GB | 260506 | 11/1926 |
| GB | 311037 | 5/1929 |
| GB | 718492 | 11/1954 |
| JP | 55014981 | 2/1980 |

* cited by examiner

VALVE-OPERATING MECHANISM

BACKGROUND

The present invention relates generally to an engine. More particularly, the present invention relates to a valve-operating system for an engine.

Engines typically include one or more pistons that reciprocate within one or more cylinders. The pistons are coupled to a crankshaft that rotates in response to the reciprocation of the pistons. The crankshaft extends out of a housing and provides shaft power to drive one or more components (e.g., wheels, lawnmower blades, snow thrower auger, and the like).

Valves, generally two or more per cylinder, are disposed adjacent the combustion chamber and open at predefined points during the reciprocation of the piston. Typically, each cylinder includes at least an intake valve and an exhaust valve. The intake valve provides for the admission of an air/fuel charge for combustion. The exhaust valve opens to allow for the discharge of products of combustion. Many different valve-operating systems are available, including push-rod systems and overhead cam systems.

Overhead cam systems generally include a cam disposed on the same side of the combustion chamber as the valves, and on an opposite side of the combustion chamber then the piston. The cam is coupled to a cam shaft that is driven by the crankshaft to assure that it rotates at a speed that is proportional to the speed of the crankshaft. The cam shaft includes one or more cam lobes that actuate the valves, or an intermediate member such as a rocker arm, in response to rotation of the cam shaft. Generally, the cam shaft is coupled to the crankshaft via a belt drive (timing belt), a chain drive, or a direct gear connection.

SUMMARY

The present invention provides a valve operating system for an engine that includes a piston that reciprocates along a piston axis. The valve operating system includes a valve member movable between a first position and a second position, a crankshaft rotatable about a crank axis, and a first plane normal to the crank axis. A second plane is normal to the first plane and parallel to the piston axis such that the piston axis is projectable onto the first plane to define a first line and onto the second plane to define a second line. A shaft is rotatable about a cam axis in response to rotation of the crankshaft. The cam axis is projectable onto the first plane to define a third line and onto the second plane to define a fourth line. The first line and the third line together define a first angle and the second line and the fourth line together define a second angle. At least one of the first angle and the second angle is oblique (i.e., the angle is either acute or obtuse). A cam member is rotatable in response to rotation of the shaft. The cam member includes a contoured surface and a rocker arm interacts with the valve member and the contoured surface to move the valve member in response to rotation of the cam member.

In another aspect, the invention provides a valve operating system for an engine that includes a piston that reciprocates along a piston axis. The valve operating system includes a valve member that is movable along a valve axis between a first position and a second position and a crankshaft that is rotatable about a crank axis. A cam member includes a substantially non-planar non-cylindrical surface and a cam profile superimposed thereon. A drive linkage interconnects the cam member and the crankshaft such that the cam member rotates in response to rotation of the crankshaft. A rocker arm is engaged with the valve member and the cam profile to move the valve member in response to rotation of the cam member.

In still another aspect, the present invention provides a valve operating system for an engine that includes a piston that reciprocates along a piston axis. The valve operating system includes a first valve member that is movable between a first position and a second position and a second valve member that is movable between a first position and a second position. A crankshaft is rotatable about a crank axis and a cam member is rotatable in response to rotation of the crankshaft about a cam axis that is parallel to and offset a non-zero distance from the piston axis. The cam member includes a first cam profile that extends around the cam axis and a second cam profile that extends around the cam axis and is disposed radially inward of the first cam profile.

Additional features and advantages will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 16 is an enlarged view of a portion of the engine of FIG. 15 taken above the line 16-16.

Before any embodiments of the invention are explained, it is to be understood that the invention is not limited in its application to the details of construction and the arrangements of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof is meant to encompass the items listed thereafter and equivalence thereof as well as additional items. The terms "connected," "coupled," and "mounted" and variations thereof are used broadly and encompass direct and indirect connections, couplings, and mountings.

DETAILED DESCRIPTION

Figure 1:
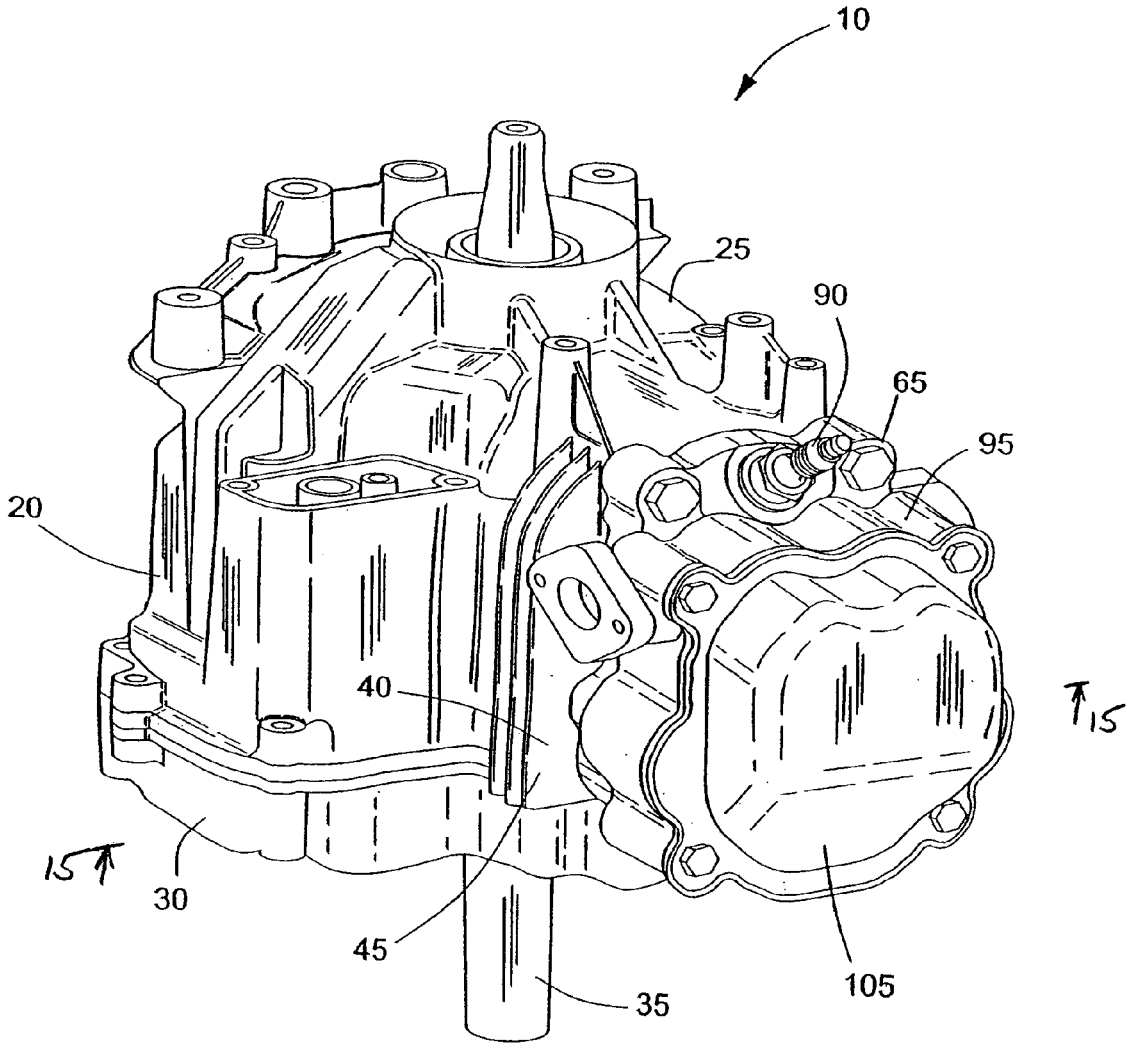
FIG. 1 is a perspective view of an engine including an engine housing.

FIG. 1 illustrates a portion of a vertical shaft engine 10 that is suited for use with a valve-operating mechanism 15 (shown in FIGS. 3 and 4) of the present invention. The illustrated engine 10 is an overhead cam engine. Engines 10 of the type illustrated in FIG. 1 are often used as a power source for outdoor power equipment such as, but not limited to, lawnmowers, snow throwers, pressure washers, generators, and the like. While the engine 10 of FIG. 1 is a single-cylinder vertical shaft engine, the present invention is suited to multi-cylinder engines and horizontal shaft engines as well.

The engine 10 includes a crankcase 20 that is divided into a first half 25 and a second half 30. The second half 30 functions as a removable cover that allows access to the internal components disposed within the crankcase 20. The first and second halves 25, 30 of the crankcase 20 provide support for a crankshaft 35, which extends out of at least one of the two halves 25, 30. As illustrated in FIG. 1, the crankshaft 35 extends out of both halves 25, 30 to allow the engine 10 to provide power take-off from one end and drive a flywheel and fan attached at the opposite end. The crankcase 20 defines an enclosed space that contains many of the moving components of the engine 10. The enclosed space also allows for the application of a lubricant such as motor oil to the moving components. The oil provides both lubrication and cooling for the various moving parts within the crankcase 20.

A cylinder 40 attaches to the crankcase 20 or is formed integral with the crankcase 20. The cylinder 40 includes a plurality of fins 45 on the exterior that facilitate the dissipation of heat during engine operation. A bore 50 (shown in FIG. 4) extends the length of the cylinder 40 and provides a reciprocating path for a piston 55. The piston 55 and the cylinder 40 cooperate to at least partially define a combustion chamber 60 (shown in FIG. 4) adjacent the top of the cylinder 40.

It should be noted that the end of the cylinder 40 spaced away from the crankshaft 35 is referred to herein as the cylinder top, or the top of the engine 10. As one of ordinary skill will realize, the position of the cylinder 40 or the orientation of the engine 10 can vary greatly. Thus, the portion of the cylinder 40 referred to as the "top" may be at the same elevation as the crankshaft 35 or even lower than the crankshaft 35. As such, the use of the terms "top" or "top of the engine" should not be read as requiring a particular engine orientation or arrangement nor should these terms be read as requiring this space to be at a higher elevation than the remainder of the engine 10 or the crankshaft 35.

With reference to FIG. 1, a cylinder head 65 is shown attached to the top end of the cylinder 40 to enclose the cylinder bore 50 and the combustion chamber 60. Two valve ports defined in the cylinder head 65 are sized to receive valve members 75 that move along valve axes 76. The two valve members 75 reciprocate along valve axes A-A (shown in FIG. 4) to open and close the valve ports in the cylinder head 65. Each valve member 75 includes a valve head 80 and a valve stem 85. The valve head 80 engages the cylinder head and provides a seal when in the closed position. The valve stems 85 extend into the cylinder head 65 and interact with respective rocker arms that actuate the valves. The cylinder head 65 may also include an opening that receives a spark plug 90 or other igniter. Of course, if the engine 10 is a compression-ignition engine (diesel), no spark plug 90 or igniter will be required.

It should be noted that the cylinder 40 (FIG. 1), cylinder head 65, and one half of the crankcase 20 can be formed integrally if desired. In addition, the separation of the crankcase halves may be angled with respect to the piston axis B-B and the crankshaft axis C-C if desired. As such, the invention should not be limited by the arrangement of the cylinder 65, cylinder head 65, and crankcase 20.

Figure 4:
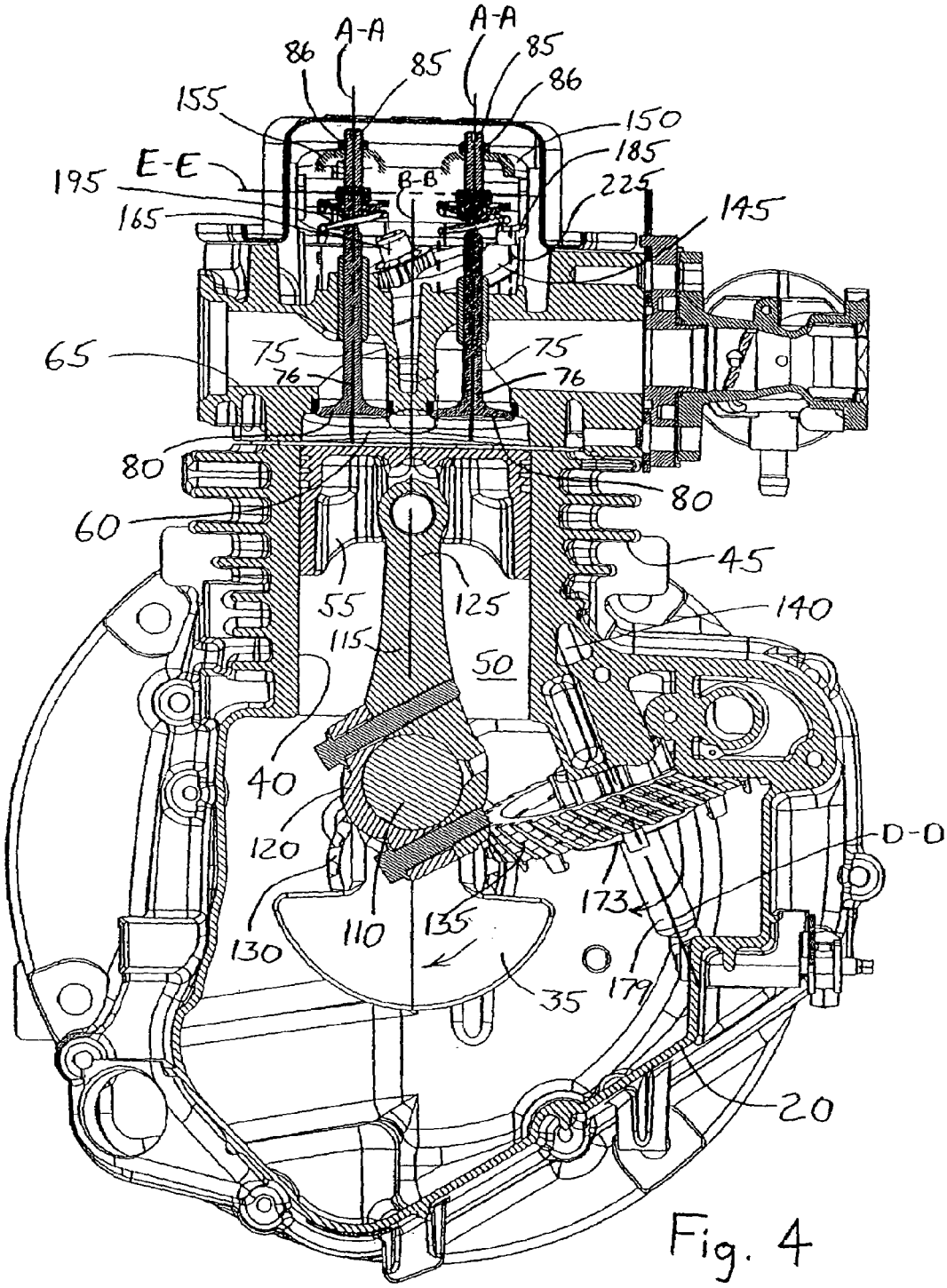
FIG. 4 is a side view of the valve-operating mechanism of FIG. 2.

As illustrated in FIG. 4, the valve members 75 reciprocate along valve axes A-A that are substantially parallel to a piston axis B-B. However, other constructions may include valves that reciprocate along axes that are not parallel to the piston axis B-B or to one another.

Figure 2:
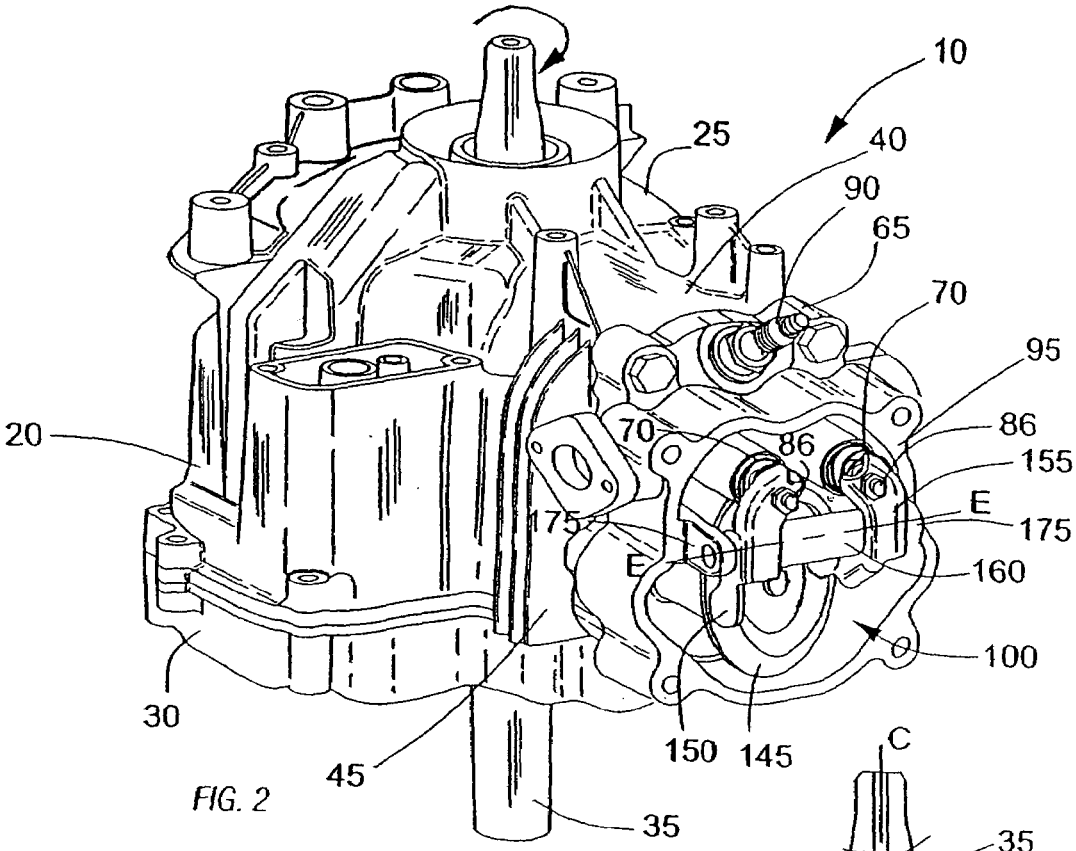
FIG. 2 is a perspective view of the top portion of the engine of FIG. 1, showing a portion of a valve-operating mechanism.

The ends 86 of the valve members 75 are contained within a rocker box 95 (shown open in FIG. 2). The rocker box 95 is formed as part of the cylinder head 65 and defines an interior chamber 100 sized to contain the valve stems 85 of the valve members 75 as well as at least a portion of any valve operating mechanism that actuates the valve members 75. A rocker box cover 105 (shown in-place in FIG. 1 and removed in FIG. 2) attaches to the cylinder head 65 and is removable to allow access to the interior 100 of the rocker box portion 95 of the cylinder head 65.

The crankshaft 35, illustrated in FIGS. 1-4, includes a crank portion 110 that is offset from a rotational axis C-C of the crankshaft 35. A connecting rod 115 (shown in FIG. 4) includes a first end 120 that connects to the crank portion 110, and a second end 125 that connects to the piston 55. This arrangement converts the reciprocating motion of the piston 55 to rotation of the crankshaft 35 about the crank axis C-C, as is well known in the engine art.

Figure 3:
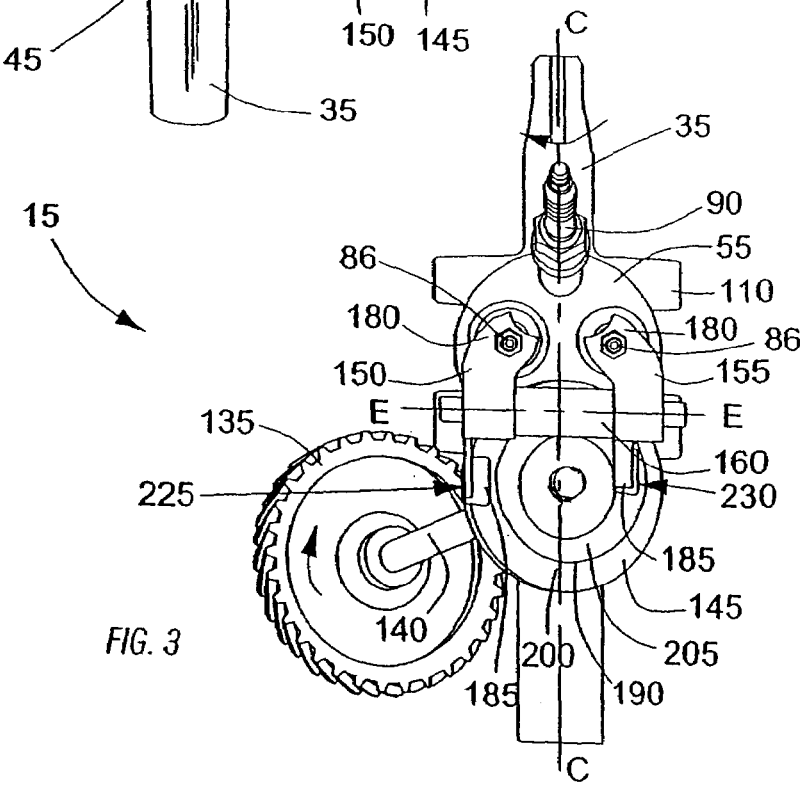
FIG. 3 is a top view of a portion of the valve-operating mechanism of FIG. 2.

With reference to FIGS. 3-4, the valve-operating mechanism 15 includes a drive gear 130, a driven gear 135, a shaft 140, a cam member in the form of a cam disc 145, a first rocker arm 150, a second rocker arm 155, and a rocker arm shaft 160. The drive gear 130 attaches to (e.g., shrunk-on, keyed, clamped, etc.) the crankshaft 35 such that it rotates with the crankshaft 35. In some constructions, the drive gear 130 may be formed as part of the crankshaft 35. As one of ordinary skill in the art will realize, the cam disc 145 is disposed on the same side of the combustion chamber 60 as the valve members 75 and on the opposite side of the combustion chamber 60 from the piston 55, thus defining an overhead cam engine.

The driven gear 135 engages the drive gear 130 and rotates in response to rotation of the drive gear 130. The gear ratio between the driven gear 135 and the drive gear 130 is two-to-one for four-cycle engines and one-to-one for two-cycle engines. Of course, other gear ratios may be desirable for other engine arrangements, such as multi-valve or multi-cylinder engines. In addition, an idler gear could be positioned between the drive gear 130 and the driven gear 135 to reverse the rotating direction of the driven gear 135 and/or to vary the gear ratio between the drive gear 130 and the driven gear 135.

The drive gear 130 and the driven gear 135 are crossed-axis helical gears that allow the rotational axes of the two gears 130, 135 to be non-parallel. Other gear arrangements and gear types (e.g., spur gears, bevel gears, or face gears)

could be used if desired. However, the use of helical gears produces a valve-actuating system 15 that requires only two gears 130, 135 and occupies a relatively small space.

Figure 10:
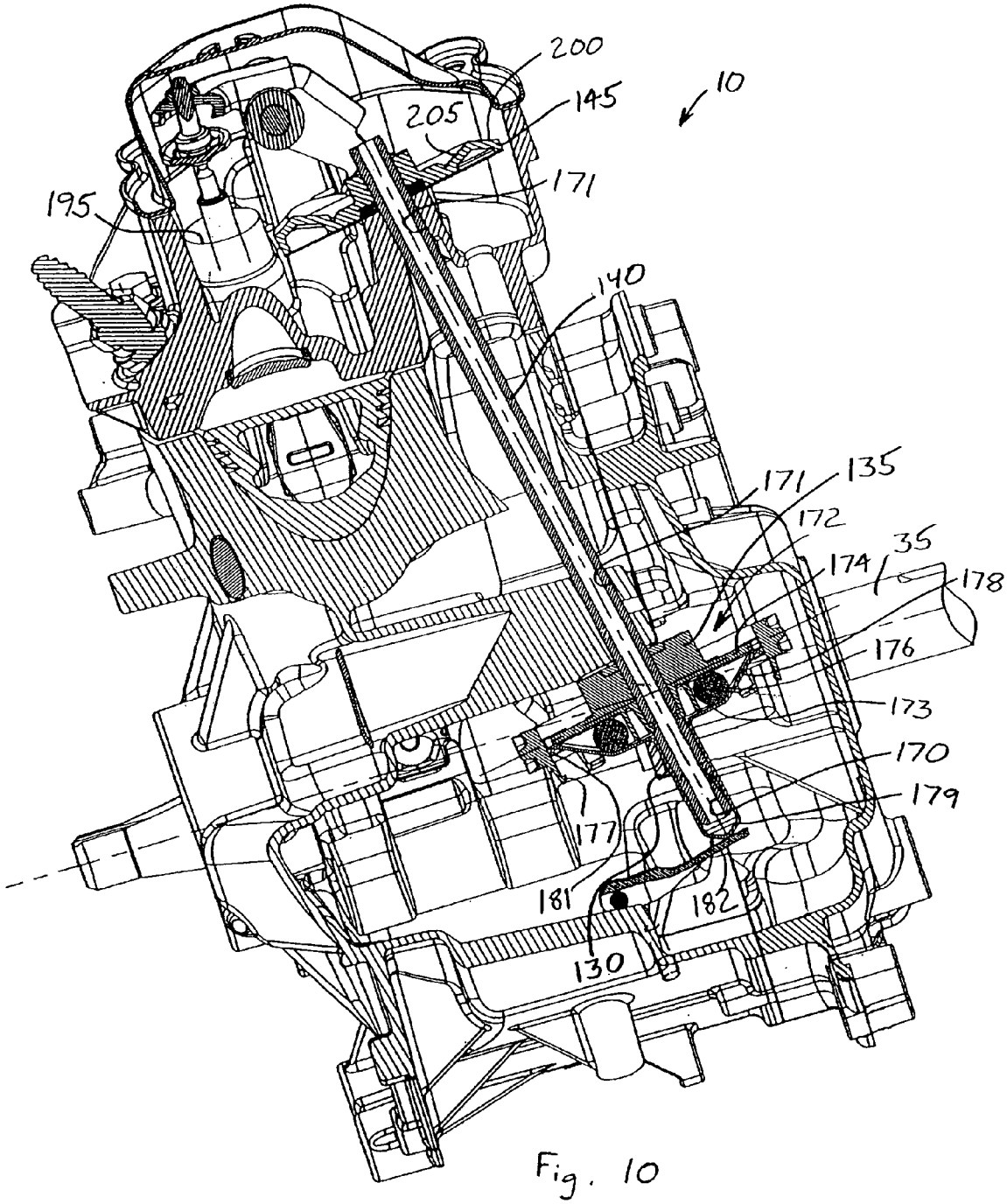
FIG. 10 is a sectional view of the engine taken along the shaft axis D-D.

The shaft 140 extends from the center of the driven gear 135 to define a cam axis D-D. In some constructions, the shaft 140 extends beyond both sides of the driven gear 135. A first end 165 of the shaft 140 extends into the rocker box 95 and drives the cam disc 145. A second end 170 of the shaft 140 extends in the opposite direction, but is contained within the crankcase 20. The second end 170 can be used to drive auxiliary equipment such as a governor or other device. As illustrated in FIG. 10, journal bearings 171 are formed as part of the crankcase 20, the cylinder 40, or the cylinder head 65 to support the shaft 140 for rotation. As can be seen, at least one end of the shaft 140 is supported in a cantilever fashion.

The position of the driven gear 135 within the crankcase 20 allows the gear 135 to act as, or to drive, an oil slinger. In most constructions, a portion of the gear 135 rotates through lubricant that collects within the crankcase 20. The lubricant then travels with the rotating gear 135 to provide lubrication between the drive gear 130 and the driven gear 135. In addition, the velocity of the gear 135 slings a portion of the oil off the gear 135, thereby distributing oil throughout the crankcase 20. In other constructions, paddles or other devices extend from the gear 135 and collect lubricant as the gear 135 rotates. The lubricant is flung from these paddles as the gear 135 rotates out of the lubricant.

Figure 15:
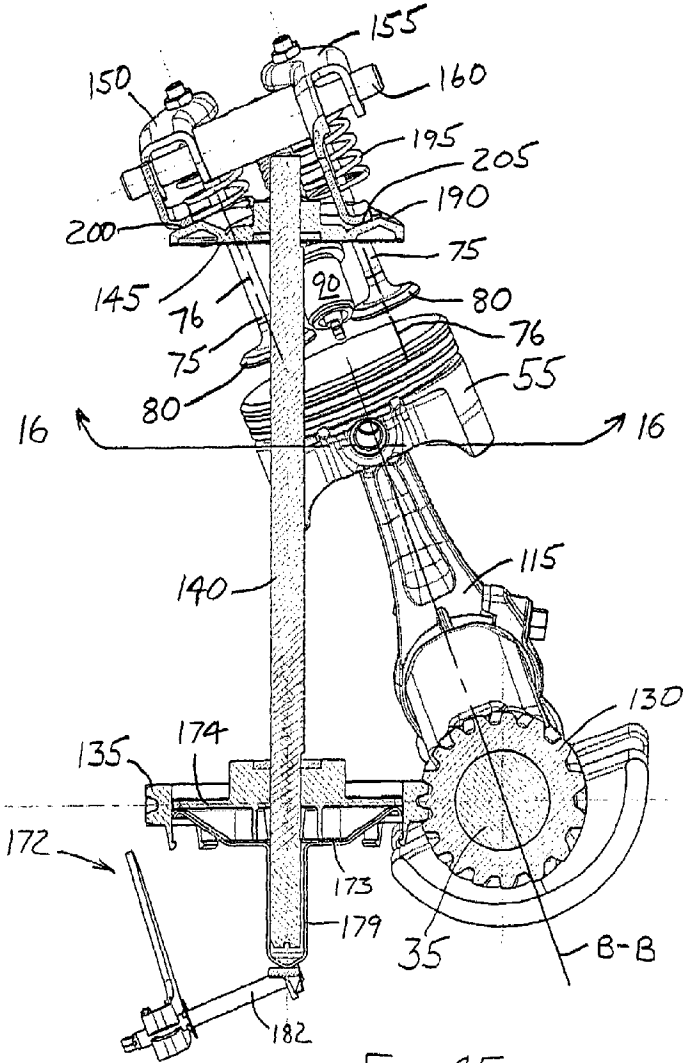
FIG. 15 is a section view of a portion of the engine of FIG. 1 taken along line 15-15 of FIG. 1.
Figure 76:
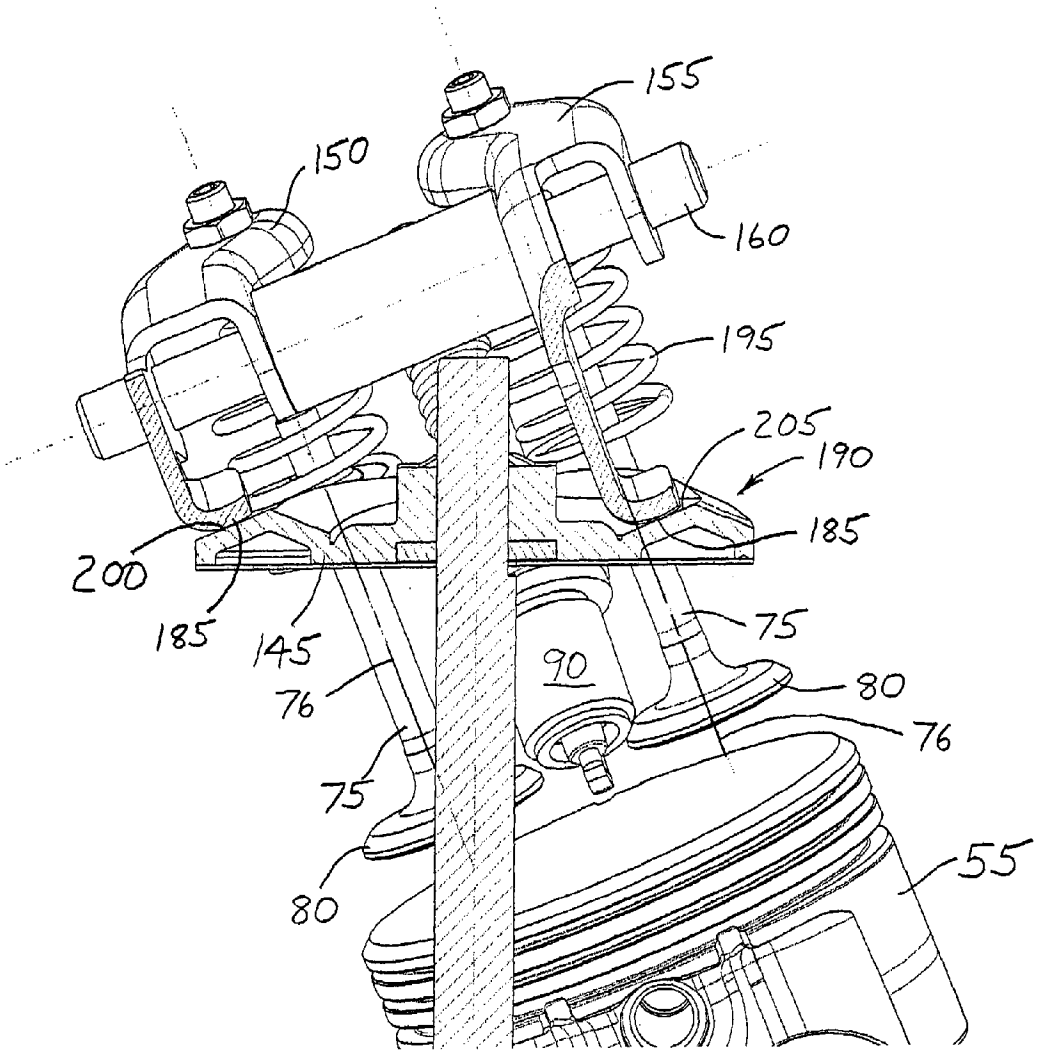

As previously stated, the second end of the shaft 170 can support auxiliary equipment such as a governor. FIGS. 4, 10, and 15 illustrate a ball governor 172 disposed on the second end of the shaft 170. FIG. 4 illustrates a slider plate 173 disposed on the end of the shaft 140 adjacent the driven gear 135. FIG. 10 illustrates the ball governor 172 as including a ball carrier 174, the slider plate 173, and a plurality of balls 176. The ball carrier 174 attaches to the driven gear 135 or is formed as part of the driven gear 135. The ball carrier 174 supports the plurality of balls 176 and provides for relatively free movement of the balls 176 in a radial direction. The ball carrier 174 also includes a plurality of teeth 177 that extend away from the ball carrier 174 in an axial direction. Other constructions may include a single tooth that extends around the entire ball carrier 174 if desired.

The slider plate 173 includes a tapered portion 178, an integrally-formed piston portion 179, and a circular hook 181. The tapered portion 178 cooperates with the ball carrier 174 to define a space that narrows as the radial distance from the shaft 140 increases. The circular hook 181 surrounds the outermost diameter of the tapered portion 178. The integrally-formed piston portion 179 slides over the second end of the shaft 170 as the slider plate 173 moves axially. A governor arm 182 engages the end of the piston 179 and moves in response to movement of the piston 179.

During operation, the crankshaft 35 rotates the shaft 140, which in turn rotates the ball governor 172. As the speed increases, centrifugal forces move the plurality of balls 176 radially outward. As the balls 176 move outward, they engage the tapered portion 178 of the slider plate 173 and begin moving the slider plate 173 axially. The axial movement of the slider plate 173 produces a corresponding movement of the governor arm 182, thus controlling the engine speed. The circular hook 181 engages the plurality of teeth 177 to inhibit disengagement of the ball carrier 174 and the slider plate 173.

FIGS. 3-4 illustrate the orientation of the shaft 140 relative to the crankshaft axis C-C and the piston axis B-B. As can be seen, the shaft 140 is not parallel to either the crankshaft axis C-C or the piston axis B-B. Rather, it is tilted relative to both axes B-B and C-C. The tilted arrangement allows the valve-actuating system 15 to be more compact. The compact valve-operating system 15 results in a more compact engine 10, shorter rocker arms 150, 155, and reduced components and assembly.

Two axes are "tilted" as used herein, when the angle defined by the projection of the axes on either one of two planes is oblique (i.e., the projected lines are not parallel or normal to one another and the angles defined by the lines are either acute or obtuse). The projection of an object as the term "projection" is defined herein is best understood as being the shadow of the object that is created by light traveling normal to the plane from a source on the opposite side of the object as the plane.

Figure 11:
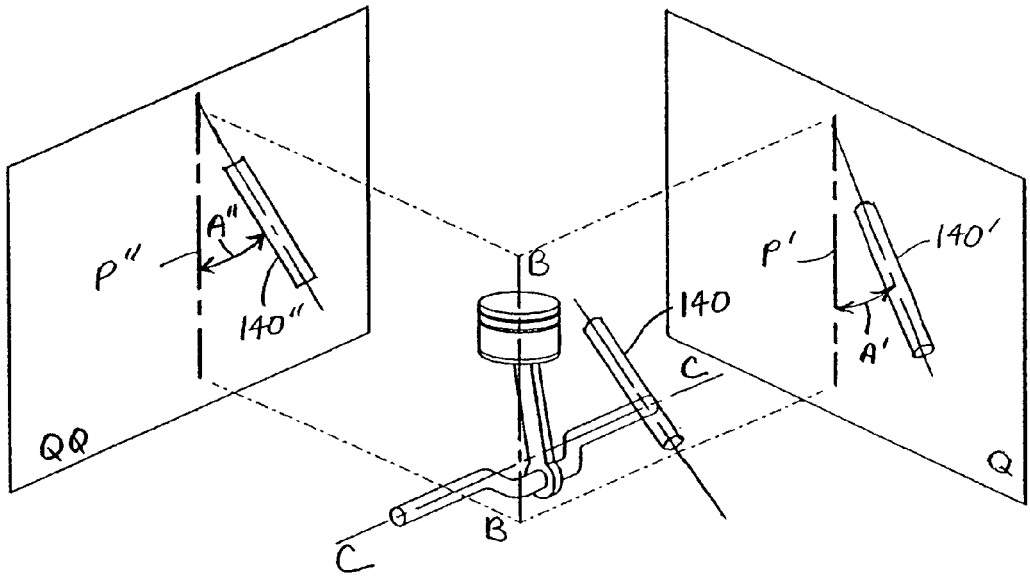
FIG. 11 is a schematic illustration of a shaft that is tilted with respect to a piston axis.
Figure 13:
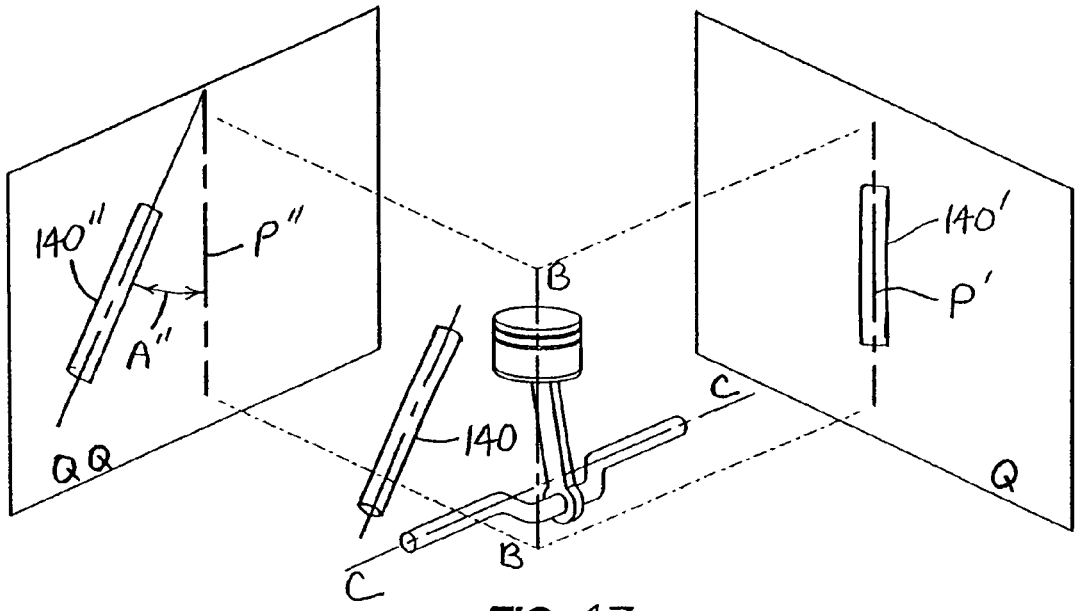
FIG. 13 is a schematic illustration of another shaft that is tilted with respect to a piston axis.

The first plane of the two planes is defined herein as a plane Q that is normal to the crank axis C-C. A second plane QQ is defined as a plane that is normal to the first plane Q and parallel to the piston axis B-B. As one of ordinary skill in the art will realize, an infinite number of planes could be chosen as plane Q and plane QQ. For the purposes of this description, any one of the infinite planes can be used as plane Q and plane QQ. FIGS. 11 and 13 illustrate examples of shafts 140 that are tilted with respect to the piston axis B-B.

In FIG. 11, the shaft 140 is not parallel to the piston axis B-B and does not reside in the plane defined by the piston axis B-B and the crank axis C-C. As illustrated, a projection 140' of the shaft 140 onto plane Q defines an angle A' that is not parallel to or normal to the projection P' of the piston axis B-B. In addition, the projection 140" of the shaft 140 onto plane QQ defines an angle A" that is not parallel to or perpendicular to the projection P" of the piston axis B-B. Thus, the shaft 140 is tilted with respect to the piston axis B-B in the example of FIG. 11.

Figure 12:
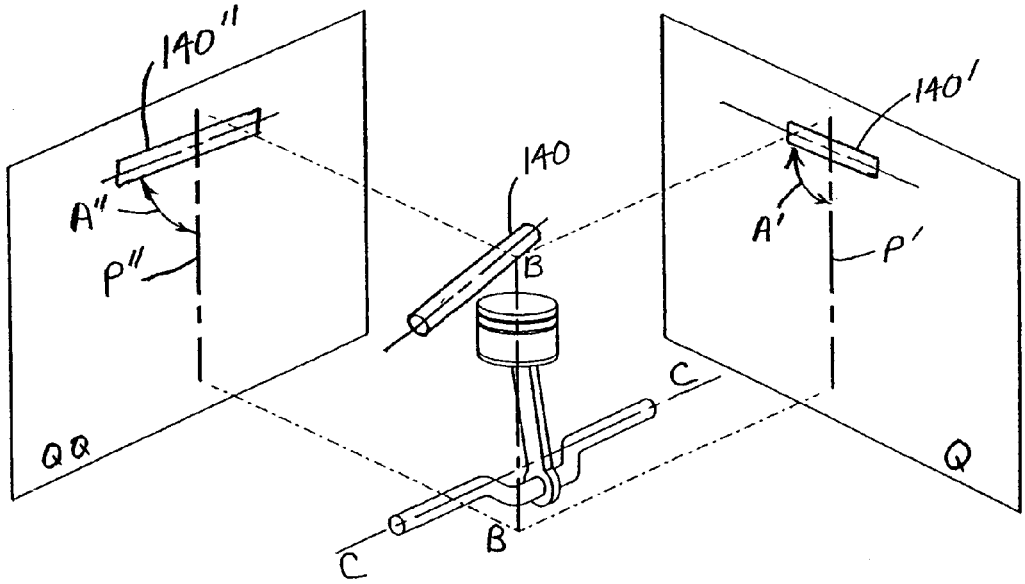
FIG. 12 is a schematic illustration of a shaft that is not tilted with respect to a piston axis.

FIG. 12 illustrates an example in which the shaft 140 would not be considered tilted with respect to the piston axis B-B as the term "tilted" is defined herein. In FIG. 12, the shaft 140 is disposed in a plane that is normal to the piston axis B-B. The projection 140' of the shaft 140 onto plane Q as well as the projection 140" of the shaft 140 onto plane QQ define 90 degree angles A', A" and are normal to the projection P'and P" of the piston axis onto planes Q and QQ respectively.

FIG. 13 illustrates another example of a shaft 140 that is tilted with respect to the piston axis B-B. The shaft 140 of FIG. 13 is disposed within the plane defined by the piston axis B-B and the crank axis C-C. The shaft 140 is not parallel to the piston axis B-B. As can be seen, the projection 140' of the shaft onto plane Q is substantially parallel to the projection P' of the piston axis B-B. The projection 140" of the shaft onto plane QQ defines an oblique angle A" that is not parallel to or normal to the projection P" of the piston axis B-B. Thus, because the projection 140" of the shaft cooperates with the projection P" of the piston axis B-B on plane QQ to define an oblique angle, the shaft 140 would be considered to be tilted with respect to the piston axis B-B in the example illustrated in FIG. 13.

Figure 14:
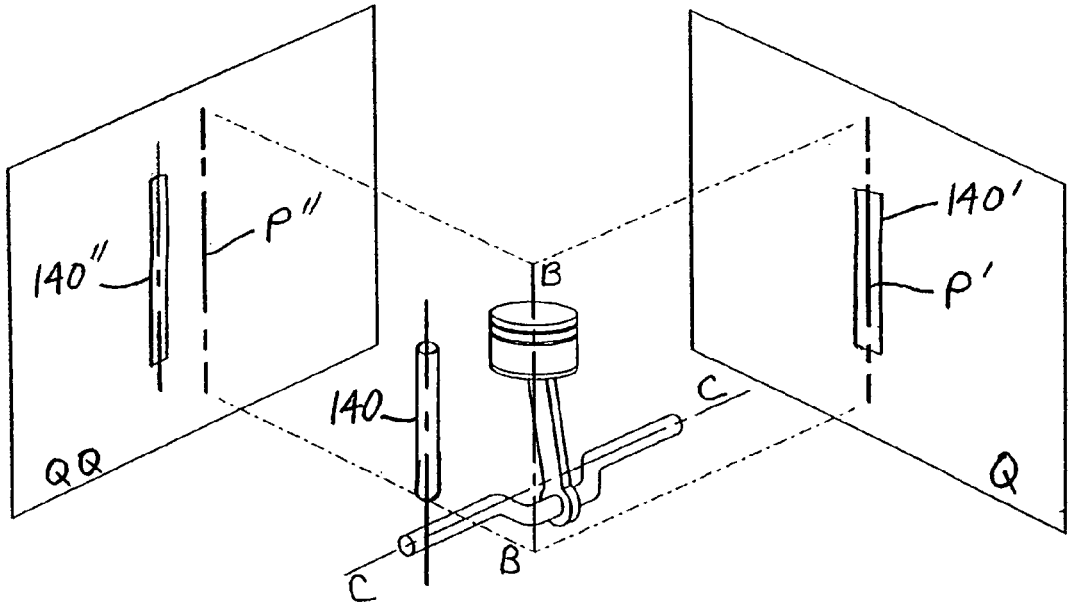
FIG. 14 is a schematic illustration of another shaft that is not tilted with respect to a piston axis.

FIG. 14 illustrates an example that is similar to the example of FIG. 13 with the exception that the shaft 140 is parallel to the piston axis B-B. The projections 140', P' onto plane Q are identical to those of FIG. 13. However, the projection 140" of the shaft 140 onto plane QQ is parallel to the projection P" of the piston axis B-B. Thus, the projections 140', 140" of the shaft onto plane Q and plane QQ are parallel to the projections P', P" of the piston axis B-B. As such, the shaft 140 of FIG. 14 would not be considered to be tilted with respect to the piston axis B-B.

With reference to FIG. 2, the cam disc 145 and rocker arms 150, 155 are illustrated in their operating positions. The rocker arms 150, 155 are pivotally supported above the cam disc 145. The rocker box portion 95 of the cylinder head includes two extensions 175 that support the rocker arm shaft 160 and define a pivot axis E-E for the rocker arms 150, 155. As already described, the illustrated construction includes two valve members 75 that move along parallel axes A-A. In constructions that include non-parallel valves, each rocker arm 150, 155 would likely require its own pivot axis.

Each rocker arm 150, 155 includes a valve-actuating portion 180 and a follower portion 185. The valve-actuating portion 180 of each rocker arm 150, 155 engages the valve stem 85, valve cap, or other intervening component of one of the valve members 75 and moves the valve member 75 between an open position and a closed position in response to rotation of the cam disc 145. Each of the follower portions 185 of the rocker arms 150, 155 engages and rides along a contoured surface 190 on the cam disc 145 as illustrated in FIG. 16. A valve spring 195 biases each of the valve members 75 into the closed position and biases each of the follower portions 185 into contact with the contoured surface 190 of the cam disc 145. Each of the rocker arms 150, 155 is pivotally supported by the rocker arm shaft 160 such that an upward movement of the follower portion 185 produces a downward movement of the valve-actuating portion 190. The distance between the rocker arm shaft 160 and the follower portion 185 or the valve-actuating portion 180 can be varied to produce the desired amount of valve lift for a given follower or cam lift. For example, a rocker arm 150, 155 could be constructed to produce a valve lift that is double the lift at the follower 185 by simply doubling the distance between the rocker arm shaft 160 and the valve-actuating portion 180 as compared to the distance between the rocker arm shaft 160 and the follower portion 185.

The cam disc 145 (shown in FIGS. 5-8) is a substantially circular disc-like member that includes the contoured surface 190. The contoured surface 190 includes a first cam surface 200 and a second cam surface 205 disposed substantially radially inward of the first cam surface 200. The two cam surfaces 200, 205 are substantially continuous, concentric, non-planar surfaces that include respective cam profiles superimposed thereon. In other words, each cam surface defines a non-planar non-cylindrical conical section that would produce no valve movement if not for the cam profile superimposed thereon.

Figure 5:
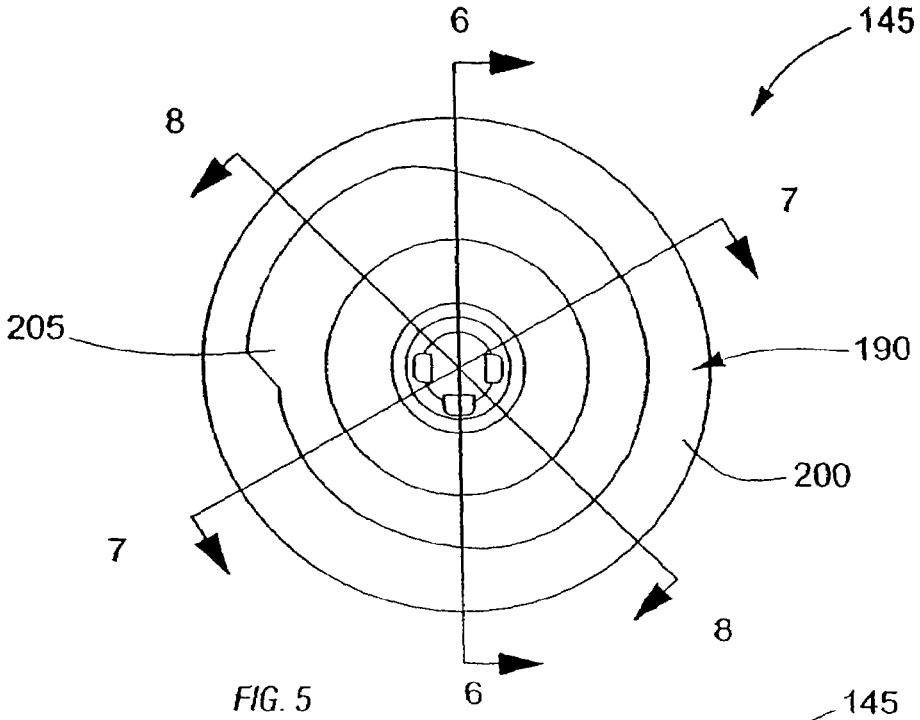
FIG. 5 is a top view of a disc of the valve-operating mechanism of FIG. 2.
Figure 6:
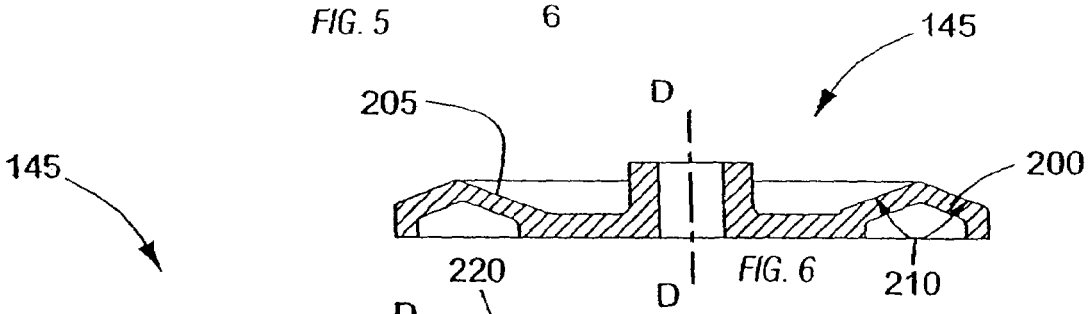
FIG. 6 is a sectional view of the disc taken along line 6-6 of FIG. 5.
Figure 7:
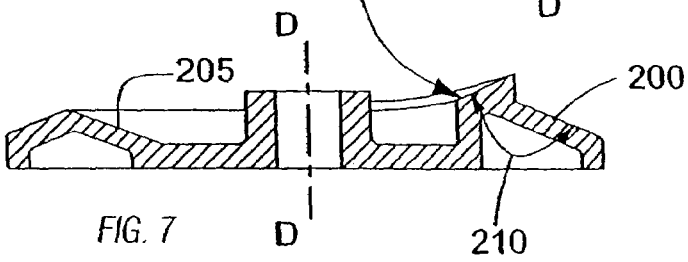
FIG. 7 is a sectional view of the disc taken along line 7-7 of FIG. 5.
Figure 8:
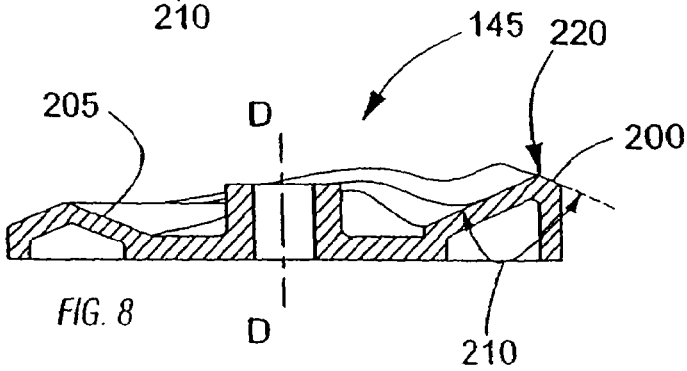
FIG. 8 is a sectional view of the disc taken along line 8-8 of FIG. 5.

FIGS. 6-8 are sectional drawings taken along various lines (planes) through the cam disc 145 (shown in FIG. 5). These figures better illustrate the orientation of the cam surfaces 200, 205 relative to one another. FIG. 6 illustrates a section of the cam disc 145 at which both cam surfaces 200, 205 are at their lowest points. Followers 185 engaged at these points position the valve members 75 in their closed positions. As can be seen, the two cam surfaces of FIG. 6 define portions of cones and they are non-planar. The actual angle of the cam surfaces 200, 205 relative to a plane orthogonal to the cam axis D-D is a function of the angle of the shaft 140 relative to the angle of the valve axis 76. For example, in one construction, the cam axis D-D (and the shaft 140) is arranged at an angle of about 20 degrees relative to the valve axis 76. In this example, the first cam surface 200 and the second cam surface 205 are both oriented at an angle of 20 degrees relative to the plane orthogonal to the cam axis D-D. If measured at points on the cam disc 145 that are approximately 180 degrees apart, these two surfaces would be substantially parallel. If measured on the same side of the cam disc 145, the two surfaces define an included angle 210 between the surfaces that is approximately 140 degrees.

A substantial portion of each of the cam surfaces 200, 205 produces a flat cam profile (i.e., the rocker arm and the valve remain in the closed position as the flat portion rotates through engagement with the follower portion). However, each cam surface 200, 205 includes a lobe 220 defined by an up transition, a plateau, and a down transition. As the lobe 220 rotates into contact with the follower 185, the follower 185 engages the up transition and the valve member 75 begins to move toward the open position. When the follower portion 185 of the rocker arm 150, 155 reaches the plateau portion, the valve member 75 is held in the open position. Further rotation of the cam disc 145 moves the down transition into contact with the follower portion 185, which allows the valve spring 195 to close the valve member 75.

FIG. 7 is a sectional view of the cam disc 145 taken at a radial angle through the lobe 220 of the second cam surface 205. When the follower 185 engages the lobe 220, the valve member 75 associated with the second cam surface 205 moves to a full open position. FIG. 8 is a sectional view of the cam disc 145 taken at a radial angle through the lobe 220 of the first cam surface 220. When the follower 185 engages the lobe 220, the valve member 75 associated with the first cam surface 200 moves to a full open position.

FIGS. 4 and 16 illustrate how the angled cam surfaces 200, 205 interact with the followers 185. The first follower portion 185 engages the first cam surface 200 at a first cam point 225. The second follower portion 185 engages the second cam surface 205 at a second cam point 230. As can be seen, the first cam point 225 and the second cam point 230 are approximately 180 degrees apart. At these two cam points 225, 230 planes that are orthogonal to the valve axis 76 are also parallel to tangents of the cam surfaces 200, 205. As such, any forces between the follower portions 185 of the rocker arms 150, 155 and the cam surfaces 200, 205 are applied substantially parallel to the valve axis 76. This arrangement reduces or eliminates undesirable side loads on the rocker arms 150, 155 or valve member 75.

Figure 9:
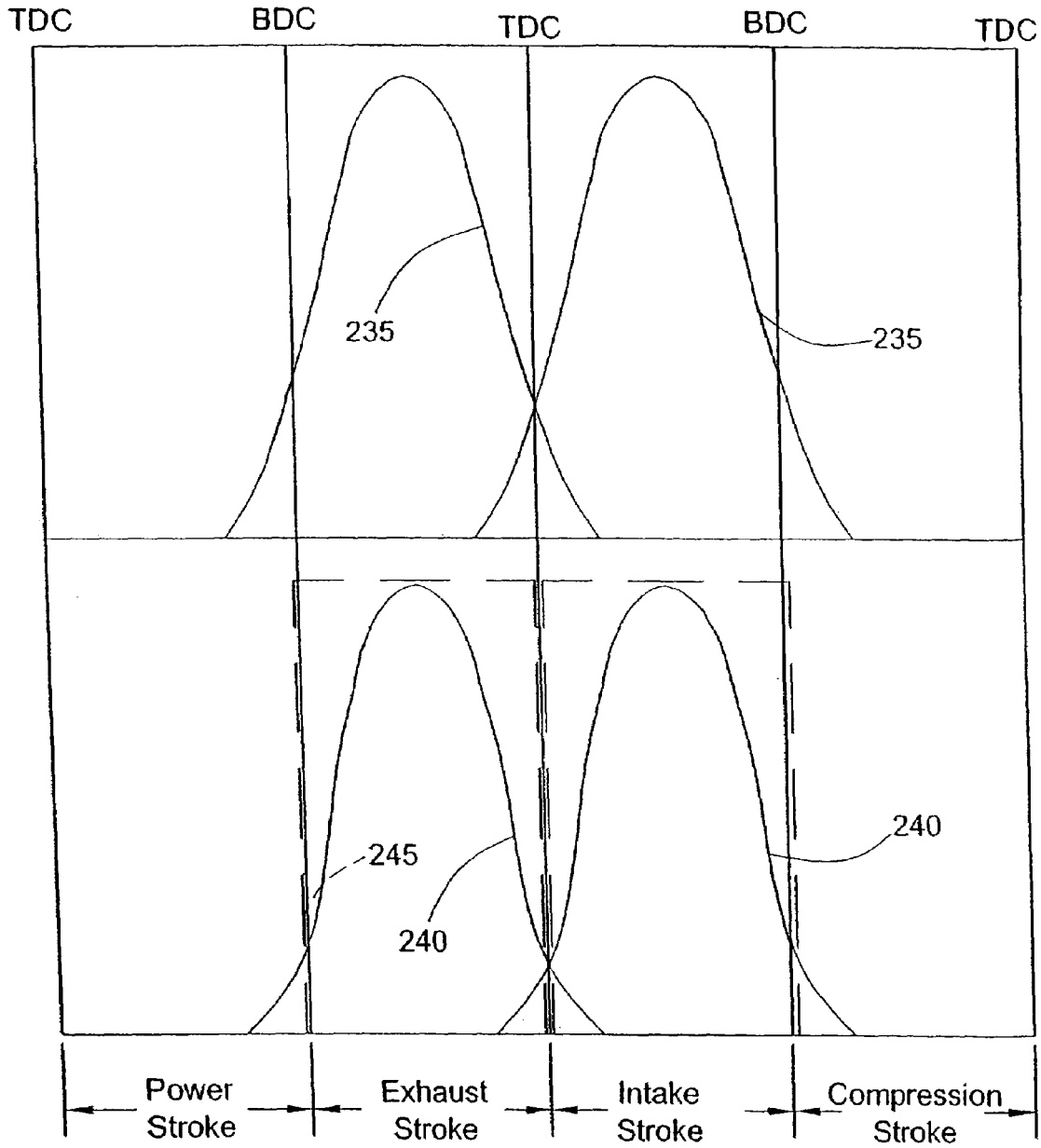
FIG. 9 is a graphical comparison of a prior art cam profile and a cam profile of the disc of FIG. 5.

The present invention allows for the use of short rocker arms 150, 155 that can be relatively light when compared to prior rocker arms. Short, light rocker arms 150, 155 are well-suited to use with cam profiles that include shorter, steeper transitions between opening and closing. An ideal valve opens and closes instantaneously (i.e., a square-wave pattern). However, as one of ordinary skill realizes, ideal valves are not attainable. As shown in FIG. 9, the present invention is able to reduce the transition times when compared to a prior valve, due to the rocker arm's reduced weight and inertia as well as its reduced size. FIG. 9 illustrates two cam profiles as measured at the cam point 225, 230. The upper plot is a prior art cam profile 235, while the lower plot is an example of a possible cam profile 240 suited to use with the present invention. As can be seen, steeper transitions and longer plateaus can be achieved with the present invention, thus moving closer to the ideal square-wave 245 (shown in broken lines). The steeper transitions reduce the transient periods and can result in an improvement of the volumetric efficiency of the engine. In addition, the steeper transitions that can be attained using the stiffer, lighter rocker arms 150, 155 of the invention can also lead to lower specific emissions and improved power output of the engine without yielding engine instability.

In operation, the piston 55 begins an intake stroke by moving down from its uppermost or top-dead-center (TDC) position to draw an air/fuel charge into the cylinder 65. During this movement, the intake valve member 75 is in its open position. As the piston 55 moves down, the crankshaft 35 and the cam disc 145 rotate. The cam disc 145 rotates to a point where the intake valve member 75 closes. The crankshaft 35 continues to rotate and moves the piston 55 again toward the TDC position to begin a compression stroke. The compression stroke continues with both valve members 75 in the closed position. The moving piston 55 reduces the volume of the cylinder 65 and increases the pressure within the cylinder 65. At a predetermined point in the compression stroke, a spark is introduced into the combustion chamber 60 and combustion occurs. The combustion drives the piston 55 down to produce usable shaft power (the power stroke) at the crankshaft 55. During both the compression and the power stroke, both valve members 75 remain closed. At the end of the power stroke, the cam disc 145 rotates to a point where the second cam lobe 230 begins to engage the follower portion 185 of the second rocker arm 155. The second rocker arm 155 opens the exhaust valve as the piston 55 again moves towards its TDC position. During this exhaust stroke, the piston 55 pushes the gases produced during combustion out of the cylinder 65. At the end of the exhaust stroke, the cam disc 145 rotates to a point that allows the second valve spring 195 to close the exhaust valve, while also opening the intake valve to begin the process again. As can be seen, the piston 55 moves to its TDC position twice during each cycle. As such, the crankshaft 35 makes two revolutions for each cycle. The two-to-one gear ratio between the drive gear 130 and the driven gear 135 allows the cam disc 145 to rotate only once during the two revolutions of the crankshaft 35, thereby maintaining the desired valve timing.

It should be noted that the foregoing description and the figures illustrate valves in one possible position and orientation. Other constructions, within the scope of the invention, position the valves in different locations or orientations.

Although the invention has been described in detail with reference to certain preferred embodiments, variations and modifications exist within the scope and spirit of the invention as described and defined in the following claims.

What is claimed is:

1. A valve operating system for an engine that includes a piston that reciprocates along a piston axis, the valve operating system comprising:

a valve member movable between a first position and a second position;

a crankshaft rotatable about a crank axis;

a first plane normal to the crank axis;

a second plane normal to the first plane and parallel to the piston axis such that the piston axis is projectable onto the first plane to define a first line and onto the second plane to define a second line;

a shaft rotatable about a cam axis in response to rotation of the crankshaft, the cam axis projectable onto the first plane to define a third line and onto the second plane to define a fourth line, the first line and the third line together defining a first angle and the second line and the fourth line together defining a second angle, at least one of the first angle and the second angle being oblique;

a cam member rotatable in response to rotation of the shaft, the cam member including a contoured surface; and a rocker arm interacting with the valve member and the contoured surface to move the valve member in response to rotation of the cam member.

2. The valve operating system of claim 1, wherein the valve member is movable along an axis that is substantially parallel to the piston axis.

3. The valve operating system of claim 1, further comprising a first gear coupled to the crankshaft and a second gear coupled to the shaft, the first gear engaged with the second gear to rotate the shaft in response to rotation of the crankshaft.

4. The valve operating system of claim 3, wherein each of the first gear and the second gear are helical gears.

5. The valve operating system of claim 1, wherein the contoured surface includes a cam profile superimposed thereon, and wherein the contoured surface is substantially non-planar.

6. The valve operating system of claim 1, wherein the contoured surface includes at least two surfaces, and wherein adjacent portions of the two surfaces are disposed at non-zero angles relative to one another.

7. The valve operating system of claim 1, wherein the contoured surface includes a first substantially annular cam surface and a second substantially annular cam surface disposed radially inward of the first cam surface.

8. The valve operating system of claim 7, wherein adjacent portions of the first cam surface and the second cam surface are non-parallel to each other.

9. The valve operating system of claim 7, further comprising a second rocker arm, wherein the first rocker arm engages the first cam surface and the second rocker arm engages the second cam surface.

10. The valve operating system of claim 1, wherein the crank axis is projectable onto the second plane to define a fifth line, and wherein the fourth line and the fifth line together define an oblique angle.

11. The valve operating system of claim 1, wherein the engine further comprises a combustion chamber, and wherein the piston is disposed on a first side of the combustion chamber, and wherein the cam member is disposed on a second side of the combustion chamber opposite to said first side.

12. The valve operating system of claim 1, further comprising a pair of gears, wherein the pair of gears provide the sole rotational connection between the shaft and the crankshaft.

13. The valve operating system of claim 1, wherein both the first angle and the second angle are oblique.

14. A valve operating system for an engine that includes a piston that reciprocates along a piston axis, the valve operating system comprising:

a valve member movable along a valve axis between a first position and a second position;

a crankshaft rotatable about a crank axis;

a cam member including a substantially non-planar non-cylindrical surface and a cam profile superimposed thereon;

a drive linkage interconnecting the cam member and the crankshaft such that the cam member rotates in response to rotation of the crankshaft; and a rocker arm engaged with the valve member and the cam profile to move the valve member in response to rotation of the cam member.

15. The valve operating system of claim 14, wherein the drive linkage includes a shaft that is rotatable about a cam axis in response to rotation of the crankshaft.

16. The valve operating system of claim 15, further comprising a pair of gears, wherein the pair of gears provide the sole rotational connection between the shaft and the crankshaft.

17. The valve operating system of claim 15, further comprising a first gear coupled to the crankshaft and a second gear coupled to the shaft, the first gear engaged with the second gear to rotate the shaft in response to rotation of the crankshaft.

18. The valve operating system of claim 17, wherein each of the first gear and the second gear are helical gears.

19. The valve operating system of claim 15, wherein the cam axis is projectable onto a first plane that is normal to the crank axis to define a first line and onto a second plane that is normal to the first plane and parallel to the piston axis to define a second line, the piston axis projectable onto the first plane to define a third line and onto the second plane to define a fourth line, the first line and the third line together defining a first angle and the second line and the fourth line together defining a second angle, at least one of the first angle and the second angle being oblique.

20. The valve operating system of claim 15, wherein the cam member rotates about the cam axis and the cam axis is offset a non-zero distance from the piston axis.

21. The valve operating system of claim 14, further comprising a second non-planar non-cylindrical surface, wherein adjacent portions of the two non-planar non-cylindrical surfaces are disposed at non-zero angles relative to one another.

22. The valve operating system of claim 14, further comprising a second non-planar non-cylindrical surface having a second cam profile superimposed thereon, the second cam profile disposed radially inward of the cam profile.

23. The valve operating system of claim 22, wherein adjacent portions of the first non-planar non-cylindrical surface and the second non-planar non-cylindrical surface are not parallel to each other.

24. The valve operating system of claim 22, further comprising a second rocker arm, wherein the rocker arm engages the first non-planar non-cylindrical surface and the second rocker arm engages the second non-planar non-cylindrical surface.

25. The valve operating system of claim 14, wherein the engine further comprises a combustion chamber, and wherein the piston is disposed on a first side of the combustion chamber, and wherein the cam member is disposed on a second side of the combustion chamber opposite the first side.

26. The valve operating system of claim 14, wherein the cam member includes a second cam profile disposed radially inward of the first cam profile.

27. The valve operating system of claim 26, wherein the second cam profiles is superimposed on a second non-planer non-cylindrical surface.

28. The valve operating system of claim 26, wherein the cam member rotates about a cam axis that is skewed with respect to the piston axis.

29. A valve operating system for an engine that includes a piston that reciprocates along a piston axis, the valve operating system comprising:

a first valve member movable between a first position and a second position;

a second valve member movable between a first position and a second position;

a crankshaft rotatable about a crank axis;

a cam member rotatable in response to rotation of the crankshaft about a cam axis that is parallel to and offset a non-zero distance from the piston axis, the cam member including a first cam profile that extends around the cam axis and a second cam profile that extends around the cam axis and is disposed radially inward of the first cam profile; and a first rocker arm interacting with the first valve member and the first cam profile to move the first valve member in response to rotation of the cam member, and a second rocker arm interacting with the second valve member and the second cam profile to move the second valve member in response to rotation of the cam member.

30. The valve operating system of claim 29, further comprising a shaft coupled to the cam member and the crankshaft such that the shaft is rotatable about the cam axis in response to rotation of the crankshaft.

31. The valve operating system of claim 30, further comprising a first gear coupled to the crankshaft and a second gear coupled to the shaft, the first gear engaged with the second gear to rotate the shaft in response to rotation of the crankshaft.

32. The valve operating system of claim 31, wherein each of the first gear and the second gear are helical gears.

33. The valve operating system of claim 30, further comprising a pair of gears, wherein the pair of gears provide the sole rotational connection between the shaft and the crankshaft.

34. The valve operating system of claim 29, further comprising a drive linkage that interconnects the cam member and the crankshaft.

35. The valve operating system of claim 29, wherein the engine further comprises a combustion chamber, and wherein the piston is disposed on a first side of the combustion chamber, and wherein the cam member is disposed on a second side of the combustion chamber opposite the first side.

36. The valve operating system of claim 29, wherein adjacent portions of the first cam profile and the second cam profile are not parallel to each other.

* * * * *